US006360487B1

(12) United States Patent
Kern et al.

(10) Patent No.: US 6,360,487 B1
(45) Date of Patent: Mar. 26, 2002

(54) RESILIENT DOOR PANEL

(75) Inventors: Rodney Kern; Joe Korman, both of Dubuque; Dave Leppert, Zwingle, all of IA (US); Peter Schulte, East Dubuque, IL (US); James Schwingle, Cuba City, WI (US); Dean Shanahan, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/394,027

(22) Filed: Sep. 10, 1999

(51) Int. Cl.[7] ..... E05D 15/06

(52) U.S. Cl. ..... 49/231; 49/370; 49/9; 52/309.6; 160/197

(58) Field of Search ..... 49/125, 226, 227, 49/228, 231, 475.1, 498.1, 483.1, 366, 370, 9; 160/197, 199, 202, 206, 211, 216, 354; 52/309.6, 309.14

(56) References Cited

U.S. PATENT DOCUMENTS

| | | | | |
|---|---|---|---|---|
| 643,307 A | | 2/1900 | Schmitt | 160/197 |
| 843,011 A | | 2/1907 | Hale et al. | 160/190 |
| 1,220,910 A | | 3/1917 | Toll | 160/190 |
| 1,245,882 A | | 11/1917 | Davis | 49/102 |
| 1,406,951 A | | 2/1922 | Fehr | |
| 1,439,373 A | | 12/1922 | Norwood et al. | 160/224 |
| 1,534,210 A | | 4/1925 | Griffith et al. | 491/102 |
| 1,681,545 A | | 8/1928 | Lang | 49/102 |
| 1,960,860 A | | 5/1934 | Allen | 160/197 |
| 2,373,023 A | | 4/1945 | Goodwin | 49/102 |
| 2,425,016 A | | 8/1947 | Weaver | 49/102 |
| 2,517,713 A | | 8/1950 | Rissler | 187/31 |
| 2,619,167 A | | 11/1952 | Eckel | 160/354 |
| 2,878,532 A | * | 3/1959 | Clark | 49/228 |

(List continued on next page.)

FOREIGN PATENT DOCUMENTS

| | | | |
|---|---|---|---|
| DE | 573632 | 3/1933 | 49/102 |
| DE | 2043 581 | 4/1971 | |
| DE | 298 08 179 | 7/1998 | |
| EP | 0 478 938 A1 | 8/1991 | |
| FR | 980892 | 5/1951 | |
| FR | 2315-598 | 6/1975 | |
| FR | 2582-343 | 5/1985 | |
| GB | 2 219 618 | 12/1989 | |
| JP | 5-118180 | 5/1993 | |
| JP | 6-72681 | 3/1994 | |
| JP | 6032572 | 5/1994 | |

OTHER PUBLICATIONS

Jamison Sound Reduction, Special Purpose, Cold Storage Doors brochure, Jamison Door Company, 1998, 8 pages.

Introducing The SST Smooth Operator System brochure, Therm–L–Tec Systems, Inc., 6 pages.

International Search Report, International Application Serial No. PCT/US00/25031 corresponding to U.S. Serial No. 09/394,027, European Patent Office, dated Dec. 19, 2000, 8 pages.

*Primary Examiner*—Jerry Redman
(74) *Attorney, Agent, or Firm*—Marshall, Gerstein, & Borun

(57) ABSTRACT

A resilient, insulated door panel for a sliding door includes a resilient core protected by a compliant outer covering with a seal disposed about the perimeter of the panel. The panel has sufficient resilience to recover from an impact that temporarily deforms it, yet has sufficient rigidity to transmit a compressive force needed for effectively setting the seals. Much of the core is filled with air to not only provide effective insulation and resilience, but to also provide an extremely lightweight door panel that can be operated to travel rapidly along an overhead track. Some embodiments include relatively rigid backup plates that provide a solid foundation to which the perimeter seals can be attached. The backup plates are segmented so as not to completely restrict the flexibility of the door panel.

22 Claims, 10 Drawing Sheets

U.S. PATENT DOCUMENTS

| | | | | | |
|---|---|---|---|---|---|
| 3,065,826 | A | | 11/1962 | Tucker, Jr. | 187/52 |
| 3,074,124 | A | | 1/1963 | Bergstedt | 20/19 |
| 3,425,162 | A | | 2/1969 | Halpern | 49/125 |
| 3,468,771 | A | * | 9/1969 | Pedlow | 52/309.6 |
| 3,529,382 | A | | 9/1970 | Salvarola | 160/197 |
| 3,675,377 | A | * | 7/1972 | Suter | 52/309.6 X |
| 3,734,238 | A | | 5/1973 | Secresty et al. | 187/1 |
| 3,805,450 | A | | 4/1974 | Forcina | 49/231 |
| 3,807,480 | A | | 4/1974 | Smart | 160/1 |
| 3,817,161 | A | | 6/1974 | Koplon | 98/39 |
| 3,854,263 | A | | 12/1974 | Eckel | 52/615 |
| 3,912,049 | A | | 10/1975 | Holland et al. | 187/61 |
| 3,987,588 | A | * | 10/1976 | Imperial et al. | 49/501 |
| 4,058,191 | A | | 11/1977 | Balbo | 187/1 |
| 4,083,148 | A | * | 4/1978 | Saucier | 49/125 |
| 4,084,347 | A | * | 4/1978 | Brown | 49/501 X |
| 4,115,953 | A | | 9/1978 | Brosenius | 49/125 |
| 4,218,104 | A | | 8/1980 | Anderson et al. | 312/214 |
| 4,404,770 | A | | 9/1983 | Markus | 49/235 |
| 4,592,270 | A | | 6/1986 | Vener | 98/39 |
| 4,637,176 | A | | 1/1987 | Acock, Jr. | 52/30 |
| 4,651,469 | A | | 3/1987 | Ngian et al. | 49/233 |
| 4,735,293 | A | | 4/1988 | Everhart et al. | 187/56 |
| 4,758,299 | A | | 7/1988 | Burke | 156/313 |
| 4,961,454 | A | | 10/1990 | Reilly, Jr. et al. | 160/344 |
| 4,987,638 | A | | 1/1991 | Ribaudo | 16/89 |
| 5,080,950 | A | | 1/1992 | Burke | 428/81 |
| 5,083,639 | A | | 1/1992 | Kappeler | 187/51 |
| 5,165,142 | A | | 11/1992 | Pilsbury | 16/90 |
| 5,195,594 | A | | 3/1993 | Allen et al. | 169/48 |
| 5,305,855 | A | | 4/1994 | Rivera et al. | 187/56 |
| 5,383,510 | A | | 1/1995 | Allen | 160/310 |
| 5,427,205 | A | | 6/1995 | Saillio et al. | 187/334 |
| 5,899,303 | A | | 5/1999 | Allen | 187/333 |

* cited by examiner

RESILIENT DOOR PANEL

BACKGROUND OF THE INVENTION

1. Field of the Invention

The subject invention generally pertains to what is known as a sliding door and more specifically to a resilient door panel for such a door.

2. Description of Related Art

So-called horizontally sliding doors (which actually may slide or roll) usually include one or more door panels that are suspended by carriages that travel along an overhead track. The carriages allow the door panels to slide or roll in a generally horizontal direction in front of a doorway to open and close the door. The movement of the panels can be powered or manually operated. Depending on the width of the doorway and the space along either side of it, a sliding door can assume a variety of configurations.

For a relatively narrow doorway with adequate space alongside to receive an opening door panel, a single panel is enough to cover the doorway. Wider doorways with limited side space may require a bi-parting sliding door that includes at least two panels, each moving in opposite directions from either side of the doorway and meeting at the center of the doorway to close the door. For even wider doorways or those with even less side space, multi-panel sliding doors can be used. Multi-panel doors have at least two parallel door panels that overlay each other at one side of the doorway when the door is open. To close the door, one panel slides out from behind the other as both panels move in front of the doorway to cover a span of about twice the width of a single panel. Applying such an arrangement to both sides of the doorway provides a bi-parting door with multiple panels on each side.

Although sliding doors are used in a wide variety of applications, they are often used to provide access to cold-storage lockers, which are rooms that provide large-scale refrigerated storage for the food industry. Doorways into such a room are often rather wide to allow forklift trucks to quickly move large quantities of products in and out of the room. When closing off a refrigerated room, sliding doors are often preferred over roll-up doors and bi-fold doors, because sliding panels can be made relatively thick with insulation to reduce the cooling load on the room.

In providing an appropriate door panel for a cold-storage application, it can be desirable to have a relatively thick, rigid door panel. The thickness generally provides better thermal insulation; while the rigidity allows a panel to seal against gaskets mounted to the stationary structure surrounding the door. Alternatively, the panel itself may carry compressive seals, and the rigidity allows the panel to accurately position its seals and allows the door panel to transmit (in a direction generally coplanar with the panel) the necessary compressive forces required to tightly engage the seals. Unfortunately, a relatively thick, rigid door creates several problems, especially in cold-storage applications.

First, door panels for cold-storage rooms are usually power-actuated to minimize the amount of cool air that can escape from the room when the door is open. Thus, for rapid operation, it is desirable to have a door panel that is as light as possible to minimize its inertia. However, the mass of a relatively thick, rigid door tends to slow it down.

Second, for doors that are designed to open automatically in the presence of an approaching vehicle, such as a forklift, a slow opening door is susceptible to being struck by a fast moving vehicle. Moreover, a closed door limits a driver's visibility to only what is in front of the door. Thus the opening of the door should be as quick as possible, not only for maintaining the temperature of the room, but also to avoid a collision between an approaching vehicle and an obstacle that may be just on the other side of the door.

Third, adding rigidity to a door panel can make it less tolerant of a collision. A stiff, rigid door panel may be more likely to permanently deform or break than a more flexible, resilient one. If a door panel is strong as well as rigid, the panel itself may be able to withstand an impact. However, if the panel does not give during an impact, the door may transmit the impact forces onto other hardware associated with the door. For example, the impact might damage door-mounting hardware, a door panel actuator or the seals. The damage could be very apparent, such as a completely inoperative door, or the damage could be difficult to detect, such as a seal that is only slightly bent or dislodged. If a damaged seal goes undetected, poor sealing could make it more difficult to maintain the proper temperature of the room, could possibly damage perishable goods stored in the room, or could cause a buildup of frost along the poorly sealed edges. Heavy frost accumulation on the seals can not only further diminish the effectiveness of the seal, but can also tear the seals as the door operates.

Although rigid door panels have their disadvantages, panels of insufficient rigidity can create problems as well. In many cases, an air pressure differential may exist across opposite faces of the door, which tends to push the door panels inward or outward. Even air pressure differentials created by a rapidly actuated panel cutting through the air can displace a relatively light panel out of its normal vertical plane. These situations can improperly position the door seals to create sealing problems similar to those caused by a damaged seal. But even if the seals are properly positioned, insufficiently rigid panels are unable to transmit the necessary compressive forces that are required to tightly set the seals. Thus, it can be difficult to provide a power-actuated, insulated door panel that is lightweight and has the proper balance of rigidity and impactability.

U.S. Pat. No. 5,080,950 discloses what appears to be a semi-rigid structural partition having some compressibility that allows it to be manually press-fit within a cargo compartment of a trailer. However, its structural properties are achieved by way of adhesively laminating several layers of materials (including multiple layers of foam material) to provide various degrees of flexibility, strength, and impactability.

SUMMARY OF THE INVENTION

In order to provide an insulated sliding door that is lightweight and resilient with the proper balance of rigidity and impactability, the door includes a door panel suspended from a carrier that travels along an overhead track. The door panel is able to transmit a significant compressive load (in a direction generally in the plane of the panel) while still being able to recover from an impact that temporarily deforms it. An actuation system moves the door, including such a panel, laterally relative to the doorway.

In some embodiments, a lightweight foam material provides the resilient core, and in other embodiments an inflatable bladder provides the resilient core.

Some embodiments include relatively rigid backup segments disposed around the perimeter of the door panel to facilitate the attachment of perimeter seals.

In some embodiments the rigid backup segments allow the door panel to flex between adjacent segments in response to a door impact.

In some embodiments, door seals are removably secured between rigid backup segments and cover plates to allow the seals to be readily replaced.

In some embodiments, a U-channel support beam connects a track-mounted panel carrier to an upper portion of a door panel, with the support beam being disposed under the panel's outer covering to help prevent the door panel from pulling away from the beam.

DESCRIPTION OF THE PREFERRED EMBODIMENT

Figure 1:
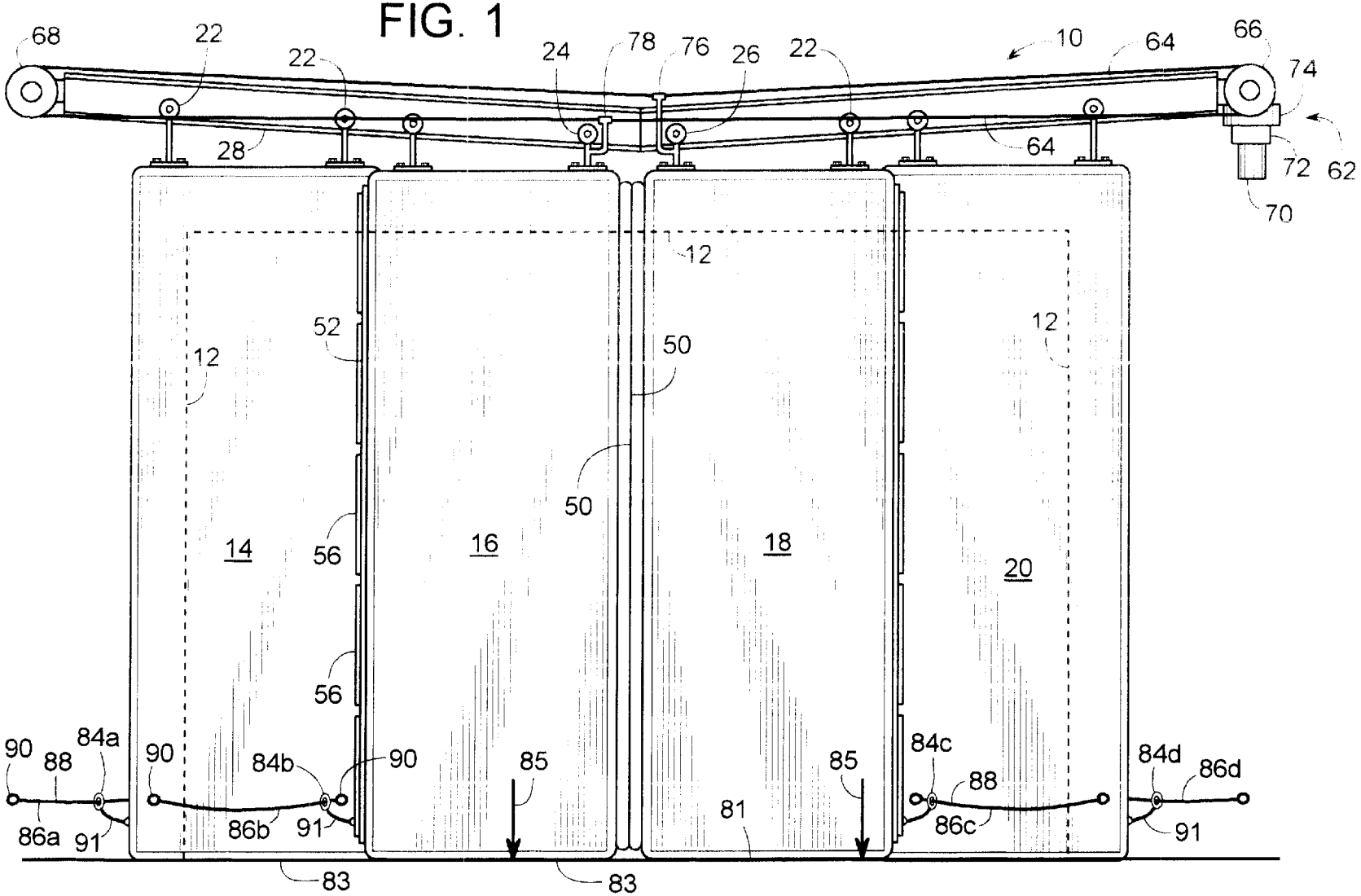
FIG. 1 is a front view of a closed door according to one embodiment.
Figure 2:
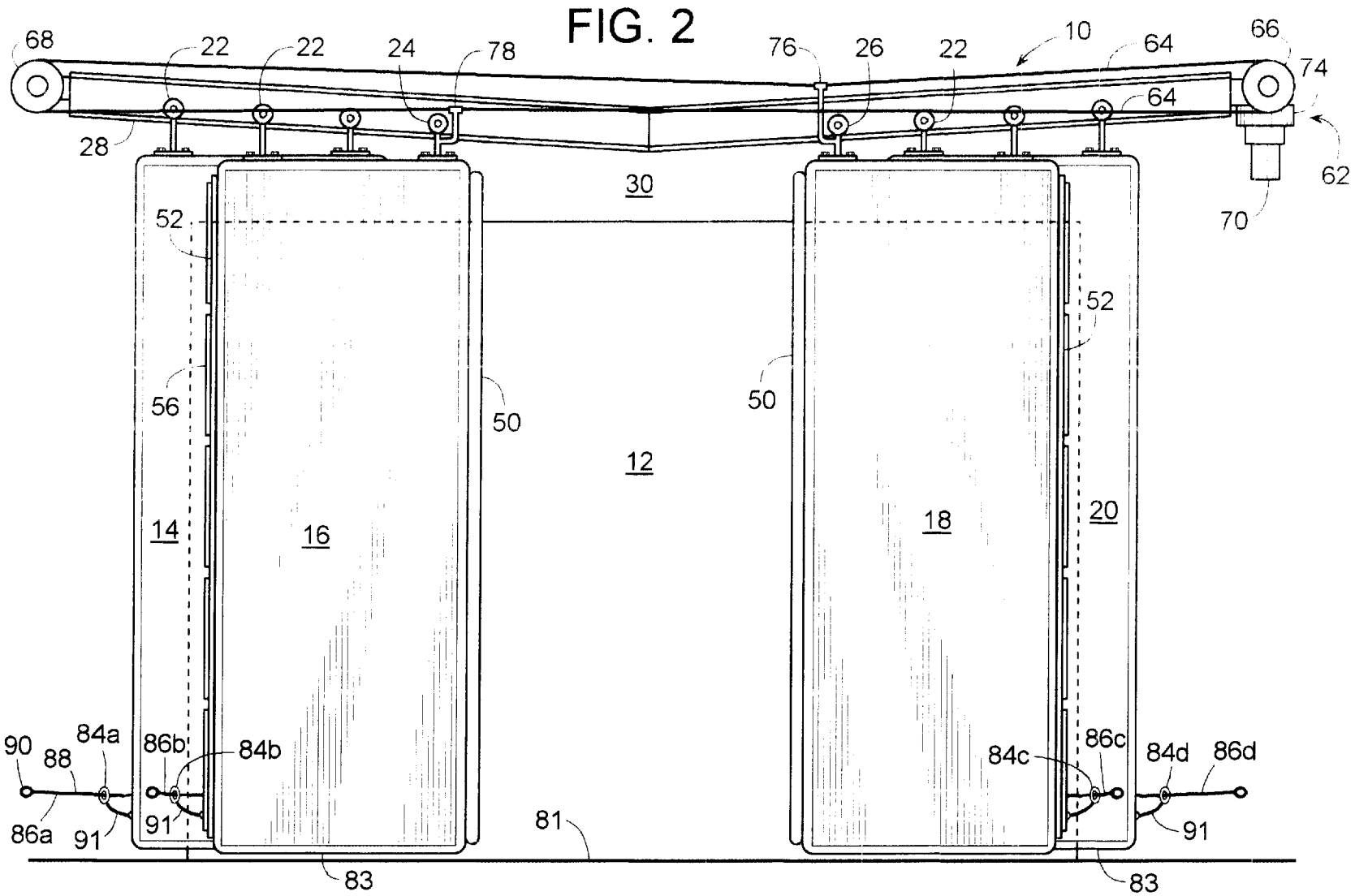
FIG. 2 is a front view of the embodiment of FIG. 1, but with the door partially open.
Figure 3:
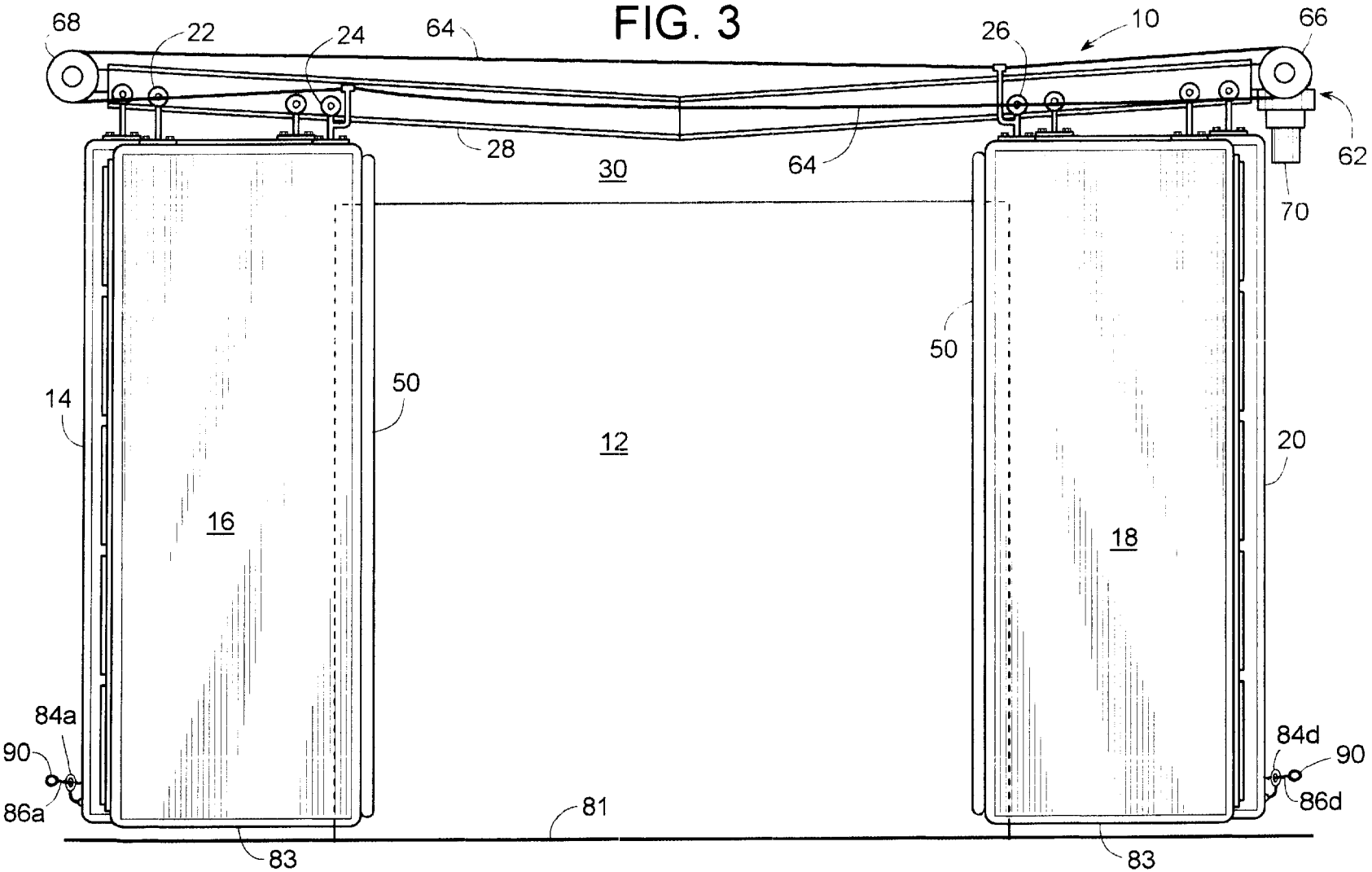
FIG. 3 is a front view of the embodiment of FIG. 1, but with the door substantially fully open.

To seal off a doorway 12 leading to a cold storage locker or other area within a building, a laterally-moving door, such as sliding door 10 is installed adjacent the doorway, as shown FIGS. 1, 2 and 3 with door 10 being shown closed, partially open, and fully open respectively. The terms, "sliding door" and "laterally-moving door" refer to those doors that open and close by virtue of a door panel that moves primarily horizontally in front of a doorway without a significant amount of pivotal motion about a vertical axis. The horizontal movement can be provided by any of a variety of actions including, but not limited to sliding and rolling. Moreover, door 10 does not necessarily have to be associated with a cold storage locker, as it can be used to separate any two areas within a building or used to separate the inside of a building from the outside. Although door 10 will be described with reference to a combination multi-panel, bi-parting door, it should be appreciated by those of ordinary skill in the art that the invention is readily applied to a variety of other sliding doors including, but not limited to multi-panel sliding doors, bi-parting doors, and single-panel sliding doors.

As for the illustrated embodiment, door 10 closes and opens between doorway blocking and unblocking positions by way of four panels 14, 16, 18 and 20 that are mounted for translation or lateral movement across doorway 12. Translation of the panels while inhibiting their rotation about a vertical axis is provided, in this example, by suspending each panel from two panel carriers. Examples of such carriers would include, but not be limited to, sliding carriages or rolling trolleys 22, 24 and 26 that travel along a track 28. Although track 28 can assume a variety of configurations, in some embodiments, track 28 is mounted to a wall 30 and situated overhead and generally above doorway 12. Although track 28 could be straight and level, in the embodiment of FIGS. 1–3, track 28 includes inclined surfaces, so that the door panels descend as they close for reasons that will be explained later. In other words, lateral movement of a door panel includes horizontal movement with optionally some vertical movement. The actual structure of panels 14, 16, 18 and 20 can vary as well.

Figure 4:
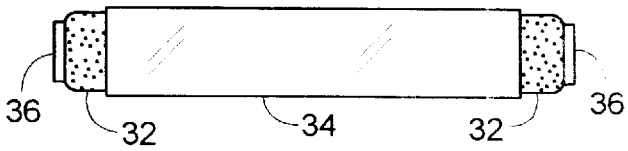
FIG. 4 is a top view of a door panel without its outer covering.
Figure 5:
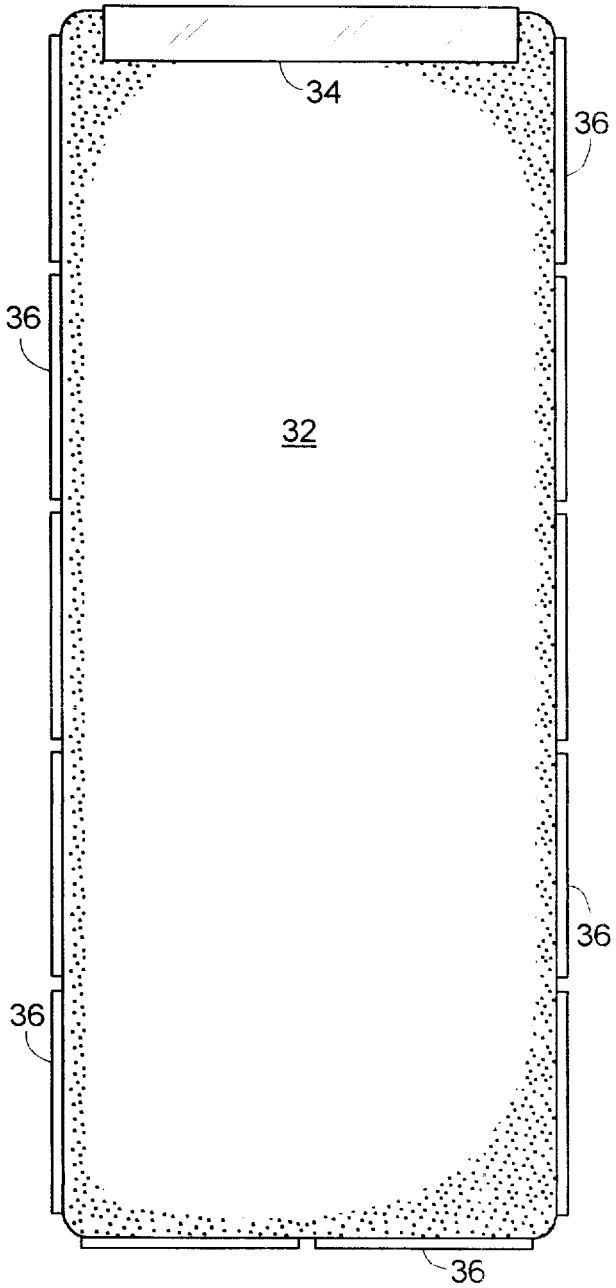
FIG. 5 is a front view of FIG. 4.
Figure 6:
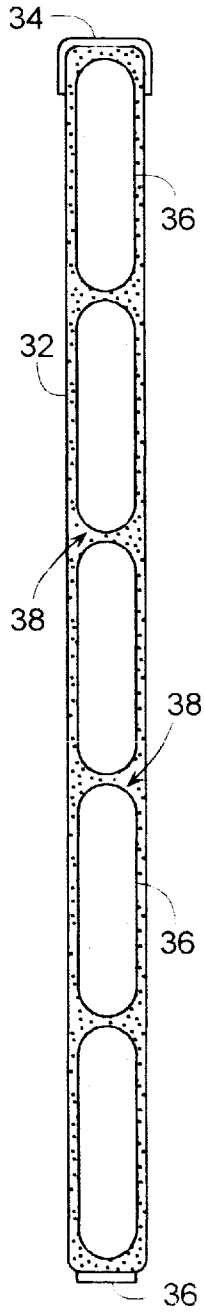
FIG. 6 is a right side view of FIG. 4.

For example, in one embodiment, to provide sufficient insulation, plus the flexibility and resilience to recover from an impact, as well as provide a relatively to lightweight panel for rapid operation, each door panel includes a generally homogeneous foam core 32, as shown in FIGS. 4, 5 and 6. In this example, core 32 consists of a 2.2 lbs/ft$^3$ density open cell polyurethane whose porosity provides a plurality of minute compressible air chambers that are depicted in the drawing figures by the stippling of core 32. The minute air chambers, whether open or closed cell, provide effective thermal insulation, minimize the weight of the door panel and are compressible (i.e., their volume can decrease under load) to accommodate the flexing of the foam during a collision. Since the panel core in this embodiment is a single piece of foam, it is compressible both vertically as well as between its opposed, generally planar faces—that is the panel is "thickness-compressible."

To provide a way to effectively connect a door panel to a trolley, a relatively rigid support beam 34 is bonded to an upper edge of core 32. In one embodiment, beam 34 is a steel channel that extends nearly the full length of the core's upper edge to more broadly distribute the load of the panel's weight hanging from its panel carriers. Broadly distributing the load avoids creating stress concentrations that may damage a door panel where the trolleys connect to the panel. Also, a pivotal or hinged connection between the panel (e.g. the channel attached thereto) and the trolleys may be desirable to allow the panels to swing relative to the trolleys in the event of an impact on the panel.

To attach seals around the perimeter of a door panel, relatively rigid backup plates 36 are bonded around the outer edges of core 32. In some embodiments, plates 36 are made of ABS (acrylonitrile-butadiene-styrene) to provide a firm foundation to which the seals can be anchored. So as not to completely restrict the flexibility of core 32, plates 36 are segmented. For example, in some embodiments, plates 36 are simply spaced apart and/or have some angular clearance 38 to allow some relative movement of adjacent plates 36. Alternatively (and preferably in some applications) a single back-up plate may be used along a given edge, with the flexibility necessary to provide the panel with impactibility being provided by the properties of the material itself rather than by relative movement between segmented plates.

Figure 7:
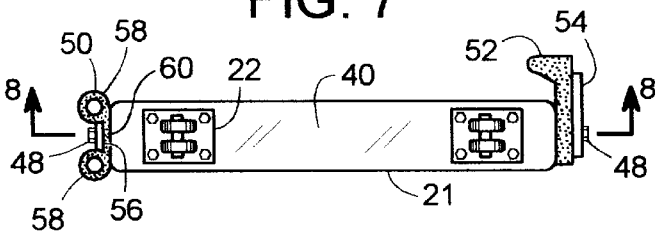
FIG. 7 is a top view of the embodiment of FIG. 4, but with its outer covering and other items installed.
Figure 8:
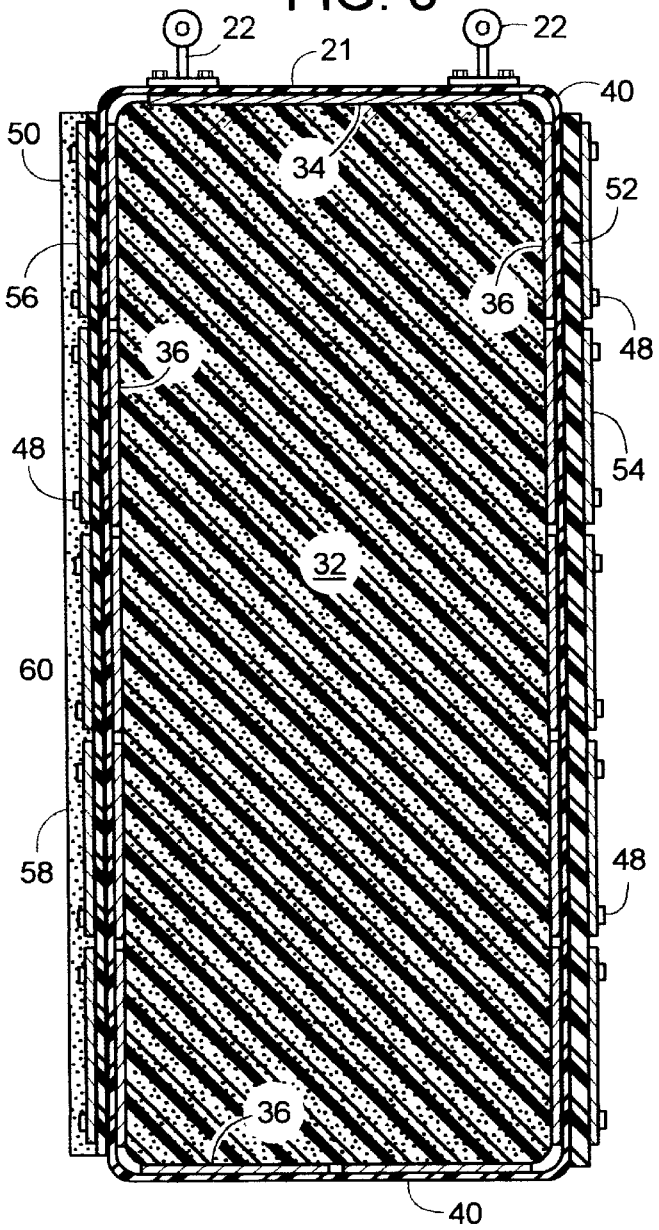
FIG. 8 is a cross-sectional view of FIG. 7 taken along line 8—8 of FIG. 7.
Figure 9:
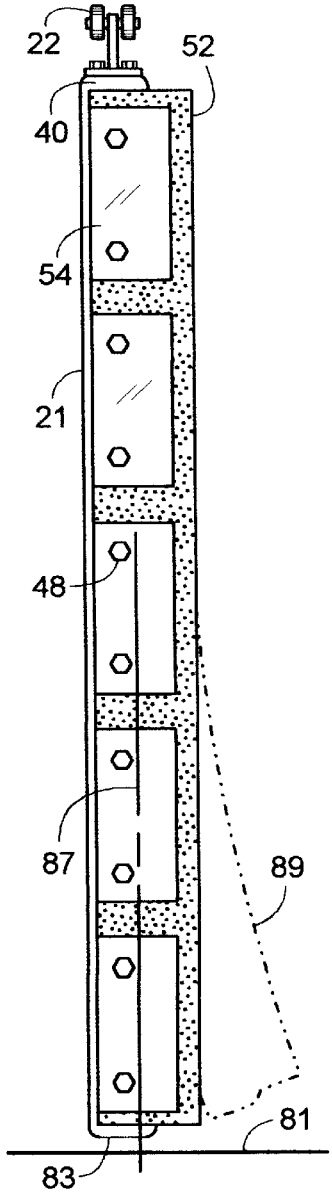
FIG. 9 is a right side view of the embodiment of FIG. 8.
Figure 10:
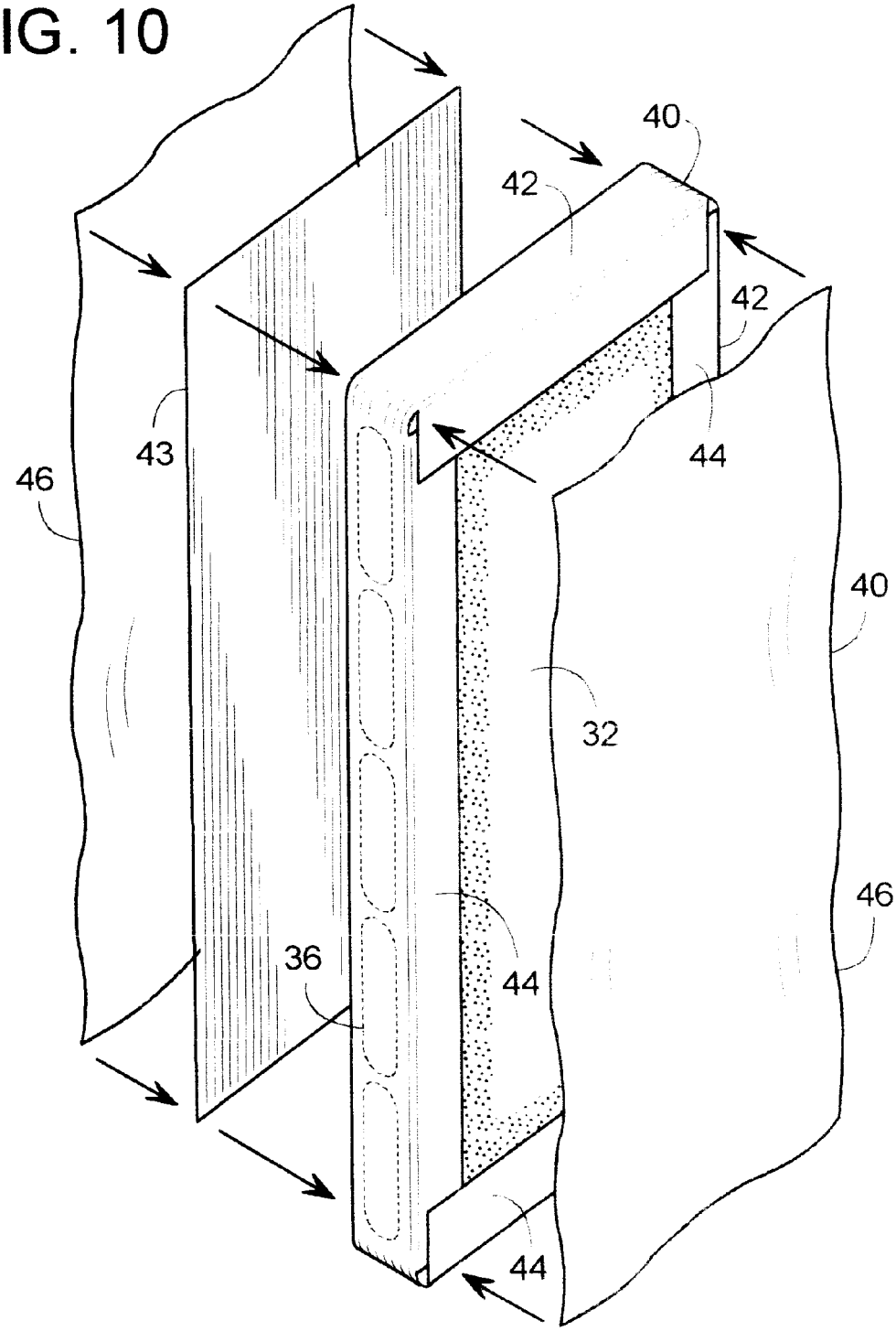
FIG. 10 is an exploded perspective view of another door panel embodiment.

To protect the foam of core 32 from wear, dirt and moisture, the assembly of FIGS. 4, 5 and 6 is covered by a flexible, but generally incompressible covering 40 to comprise a door panel such as panel 21, as shown in FIGS. 7, 8 and 9. Although cover 40 could be any of a variety of materials, in some embodiments cover 40 consists of a polyester-based fabric impregnated with polyurethane to provide sufficient toughness, flexibility or compliance, and impermeability of water and dirt. Any of a wide variety of approaches to material folding, overlapping and joining can be taken in wrapping cover 40 around core 32. For example, in the embodiment of FIG. 10, cover 40 includes one section 42 that is wrapped around the perimeter of core 32 with folded-over portions 44 that partially cover the face of core 32. The remaining exposed surfaces of core 32 are then covered by sections 46, which can be bonded or in some other way attached to the folded over portions 44. In one embodiment, section 42 is a polyester-based fabric impregnated with polyurethane while sections 46 are made using a polycarbonate sheet. In some embodiments, a tough, semi-rigid sheet 43 (e.g., ABS, polycarbonate, etc.) is sandwiched between cover 46 and core 32 to provide cover 46 with some additional support (e.g., puncture resistance) and to help protect core 32. Sheet 43 can be installed on one or both sides of core 32, or can be omitted altogether.

To inhibit the weight of a panel from pulling core 32 out from channel 34, in some embodiments cover 40 wraps over channel 34, so cover 40 helps hold channel 34 and core 32 together. Trolleys 22 are then bolted or attached in some other way to support beam 34 with a portion of cover 40 sandwiched between beam 34 and trolleys 22, as shown in FIGS. 7, 8 and 9.

To replaceably attach soft compressive foam seals to the edges of panel 21, screws 48 screw into backup plates 36 to secure a leading edge seal 50 and a trailing edge seal 52 between backup plates 36 and similarly rigid cover plates 54 and 56. Similar to backup plates 36, cover plates 54 and 56 are segmented in a spaced-apart relationship and/or include end clearance to maintain some flexibility of panel 21. To engage a corresponding mating sealing surface of an adjacent door panel, trailing edge seal 52 protrudes out of coplanar alignment with one face of panel 21. Likewise, cover plates 54 are offset to one side of panel 21 to provide seal support that prevents the relatively soft and compliant seal 52 from just folding back upon itself as it engages its mating sealing surface. For leading edge seal 50, in one embodiment, seal 50 comprises two foam tubular members 58 joined by an interconnecting fabric web 60. Cover plates 56 situated between tubular members 58 clamp web 60 to backup plates 36, with cover 40 being interposed between backup plates 36 and web 60. Although specific examples of panel seals have just been described, it should be appreciated by those of ordinary skill in the art that various other seal designs are possible. For example, seals can be disposed generally along the perimeter of a panel but attached to the panel's face as opposed to being attached directly to the edges of the panel. And in some applications the seals can be omitted altogether.

Those skilled in the art should also appreciate that the operation of a sliding door can be carried out by a variety of well-known actuation systems. Examples of an actuation system for moving a panel laterally relative to the doorway include, but are not limited to, a chain and sprocket mechanism; rack and pinion system; cable/winch system; piston/cylinder (e.g., rodless cylinder); electric, hydraulic or pneumatic linear actuator; and a rotational actutator, such as a scissors linkage system, pitman arm, or an arm that rotates a panel along the plane of the panel in a broad sweeping motion between doorway blocking and unblocking positions. One example of an actuation system is best understood with reference to FIGS. 1–3 with further reference to FIGS. 11–14. In this example, door 10 is power-operated by a drive unit 62 that moves lead panels 16 and 18 either apart or together to respectively open or close door 10. Drive unit 62 includes a cogged belt 64 disposed about two cogged sheaves 66 and 68. Sheave 66 is driven by a motor 70 through a gear reduction 72 and a clutch 74, while sheave 68 serves as an idler. If desired, additional idlers can be added near the central portion of track 28. Such additional idlers could pull belt 64 downward near the center of the doorway, so that the upper and lower portions of belt 64 generally parallel the double-incline shape of track 28. One clamp 76 couples trolley 26 of panel 18 to move with an upper portion of belt 64, and another clamp 78 couples trolley 24 of panel 16 to move with a lower portion of belt 64. Thus, depending on the rotational direction that motor 70 turns sheave 66, panels 16 and 18 move together to close the door or move apart to open it.

Figure 11:
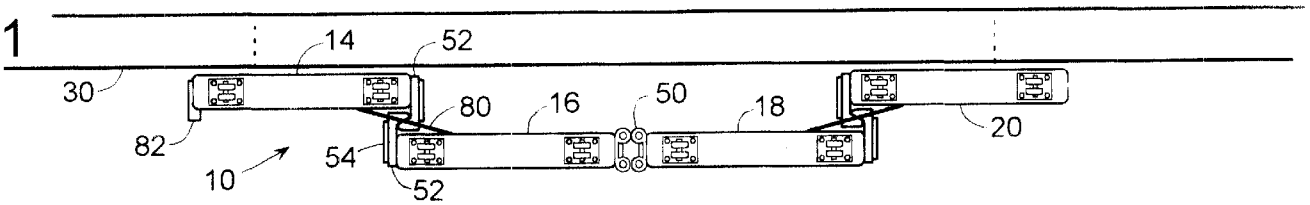
FIG. 11 is a schematic top view of a closed door according to one embodiment.
Figure 12:
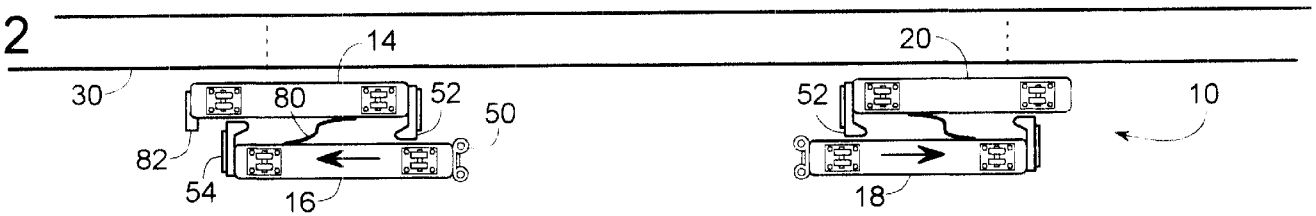
FIG. 12 is the same as FIG. 11, but with the door in the process of opening.
Figure 13:
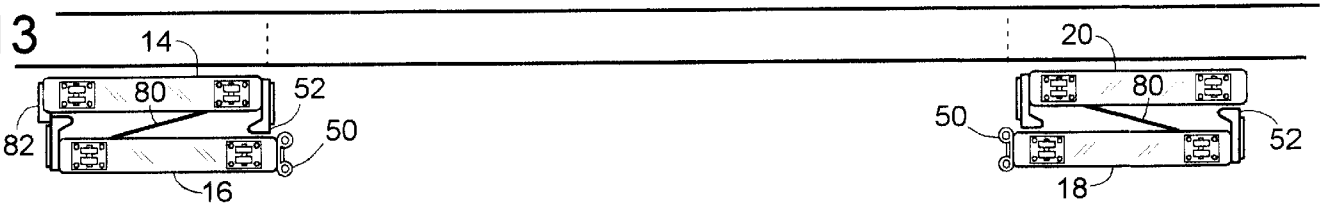
FIG. 13 is the same as FIG. 11, but with the door substantially fully open.

To open door 10 from its closed position of FIGS. 1 and 11, drive unit 62 turns sheave 66 clockwise (as viewed looking into FIG. 1). This moves belt 64 to pull lead panels 16 and 18 apart from each other and away from the center of the doorway. The outward movement of lead panels 16 and 18 causes their respective lag panels 14 and 20 to move outward as well. The outward movement of lag panels 14 and 20 can be accomplished by a variety of well-known devices. For example, in one embodiment, lag panels 14 and 20 are simply tied to their respective lead panels 16 and 18 by way of a flexible connector such as a strap 80. As lead panels 16 and 18 are driven from being fully closed (FIG. 11) to fully open (FIG. 13), straps 80 cause the lead panels to pull their corresponding lag panels open as well. As door 10 begins to open, strap 80 slackens before the lead panels start pulling the lag panels along with them, as shown in FIG. 12.

Figure 14:
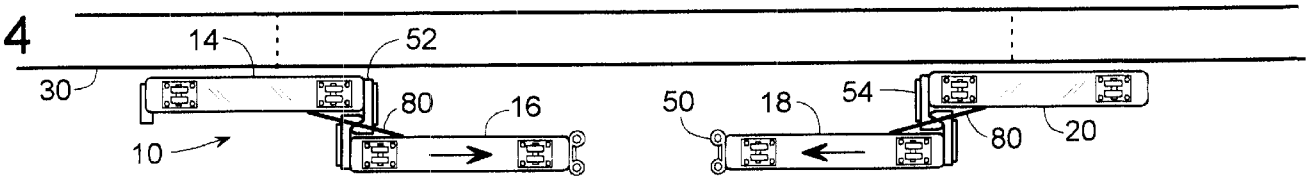
FIG. 14 is the same as FIG. 12, but with the door in the process of closing.

To close door 10, drive unit 62 turns sheave 66 counterclockwise, which moves belt 64 to pull lead panels 16 and 18 together towards the center of doorway 12. Straps 80 are short enough to cause the lead panels to pull their corresponding lag panels toward the closed position also, as shown in FIG. 14. However, straps 80 are sufficiently long to allow trailing edge seal 52 of lead panel 16 to engage a mating seal 52 on adjacent lag panel 14. In some embodiments, the interengagement of seals 52 are relied upon to pull lag panel 14 closed. Then by adding a protruding stop member 82 on the trailing edge of lag panel 14, such that it protrudes to engage a back surface of seal 52 of panel 14, the need for straps 80 can be eliminated, as the movement of seal 52 of panel 16 will then be constrained to travel within seal 52 and stop 82 of lag panel 14.

To ensure that bottom edges 83 of door panels 14, 16, 18 and 20 firmly seal against a floor 81 as door 10 closes, track 28 slopes downward toward the center of doorway 12. Thus, as door 10 closes, as shown in FIG. 14, and panels 14, 16, 18 and 20 move to their closed positions of FIG. 1, the decline of track 28 lowers the door panels to push edges 83 down firmly against floor 81. Bottom edges are seated against floor 81 with a compressive load 85 that is at least partially provided by at least some of the weight of the door panels (e.g., the weight of foam 32 and/or the weight of cover 40). In other words, when door 10 is closed, the bottom edges 83 are in compression while the upper portion of the door panels may be compression or tension, depending on whether the magnitude of compressive load 85 is greater or less than the panel weight.

To this end, each panel is provided with sufficient rigidity to transmit a compressive load 85 in a direction generally within the same plane along which the panel normally lies when in its relaxed shape, and do so without appreciable distortion to the panel. The term, "appreciable distortion" refers to a door panel deflecting more than its nominal thickness.

The phrase, "transmit a compressive load in a direction generally within the same plane along which the panel normally lies when in its relaxed shape" is best understood with reference to a panel that is at rest against an object (floor, wall, other panel) that is stationary relative to the panel. The panel transmits a compressive load when any applied load directed toward the object (the force has a component in that direction) and directed within the plane of the panel (the force has a component in the plane of the panel) produces a reactive load at the panel/object interface. Examples are pushing the panel into the floor, and pushing the nose of one panel against the nose of the other (here the applied force is at an angle to the compression since the force is being applied at the top, and reacted along the nose).

Referring to FIG. 9, for example, panel 21 shown in its relaxed free-hanging state lies along a plane 87. When lowered against floor 81 (as the panels shown in FIG. 1), at least some of the weight of panel 21 is transmitted along plane 87. If desired, compressive force 85 can exceed the weight of panel 21. For example the upper flange of track 28 can be situated to push down against the top of trolley rollers 22 as the door panels move down toward the lower portion of track 28. If desired, a compliant seal can be installed along bottom edges 83 for wear resistance or to enhance the seal between floor 81 and the door panels.

It should be noted that the same general principle of transmitting compressive force 85 along plane 87 to seal against floor 81 could also be adapted in setting vertical seals 50. For example, drive unit 62 pulling door 10 shut could create a compressive force along plane 87 that forces seals 50 tightly against each other. For vertical seals, such as seals 50, the rigidity of the door panels also helps ensure that the seals are maintained in their proper alignment with each other as they come together.

Although each door panel is provided with sufficient rigidity for adequate seal positioning and/or seal compression, core 32 also provides each door panel with sufficient resilience to substantially recover its relaxed shape after a collision. Referring to FIG. 9, when an impact deforms panel 21 appreciably out of coplanar alignment with plane 87 (as indicated by phantom line 89), panel 21 is able to spring back to its generally planar, relaxed shape (as indicated by solid lines). The term, "appreciably out of coplanar alignment" refers to a door panel deflecting more than its nominal thickness.

Figure 21:
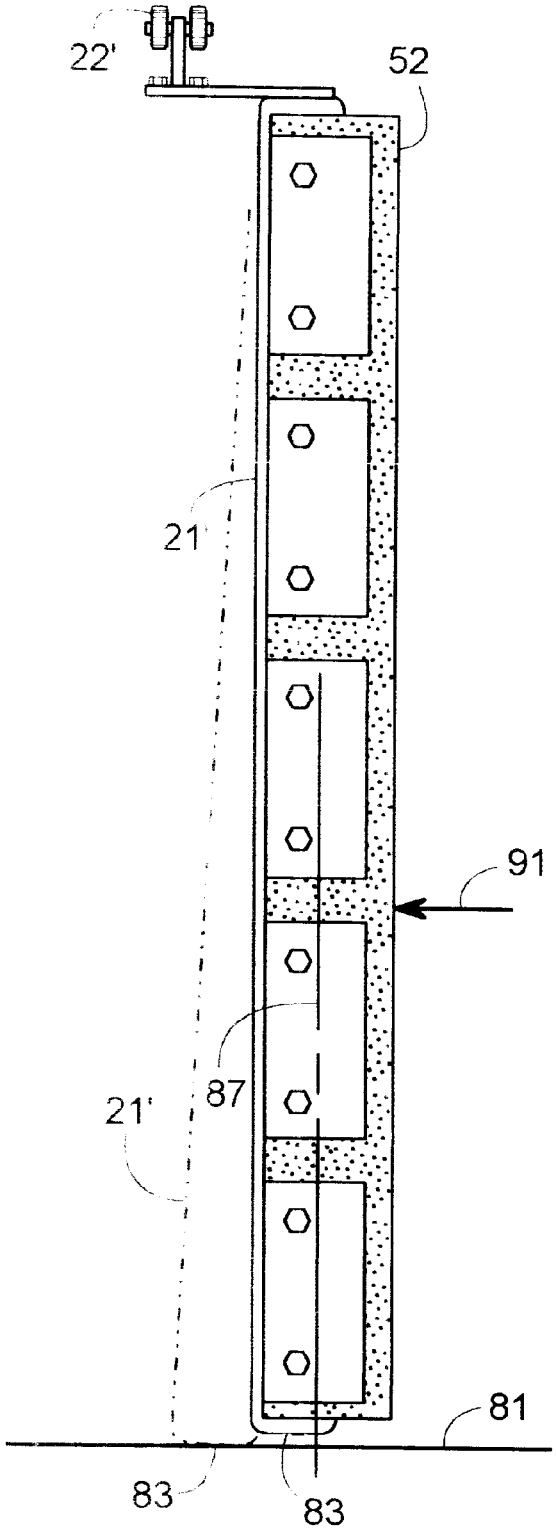
FIG. 21 is an end view of another embodiment of a door panel.

Note that the ability of the panel to transmit a compressive load may not necessarily be used to set the door in a sealing configuration when closed. Rather, this ability to transmit a compressive load may come into play once a wind load or other force directed into the plane of the doorway is applied (e.g., a force directed "through" the door). The door in the closed position may be spaced from the floor, as with the example of door panel 21' of FIG. 21. Rollers 22' support door panel 21' from a position offset to plane 87, so that bottom edge 83 is normally held slightly above floor 81. Counterbalance weights or other external forces may be applied to place panel 21' in a desired vertical or leaning orientation. Then when a wind load or other force, such as a force 91, is directed into plane 87, panel 21' deflects and/or swings into the position shown in phantom lines. This causes bottom edge 83 to engage floor 81, thereby putting panel 21' in compression at that time. In this example, the swinging motion of panel 21' is centered around offset roller 22'; however, other rotational center points may be used as well.

In some embodiments, to guide the lower edges of the door panels and to prevent a pressure differential across the door from deflecting the door excessively, each panel is associated with a slide 84*a–d* that slides along a slide restraint 86*a–d*. For the embodiment of FIGS. 1–3, each slide 84*a–d* is steel ring, and each slide restraint 86*a–d* is an elongated nylon strap 88 threaded through one of the rings and anchored at each end 90 of the strap. To restrain panel 14, restraint 86*a* is attached to wall 30 with its corresponding slide 84*a* being attached to panel 14. To restrain panel 16, restraint 86*b* is attached to lag panel 14 with its corresponding slide 84*b* being attached to lead panel 16. To restrain panel 18, restraint 86*c* is attached to lag panel 20 with its corresponding slide 84*c* being attached to lead panel 18. To restrain panel 20, restraint 86*d* is attached to wall 30 with its corresponding slide 84*d* being attached to panel 20. For this exemplary embodiment, each ring is attached to its appropriate panel by way of a short strap 90. Although the actual structure of the slides and slide restraints can vary, in some embodiments it is preferable to use a strap and ring design. With such a design, if a vehicle strikes door 10, the flexibility of strap 88 allows a door panel to yield without breaking either a panel or the slide restraint. And a slide that encircles the strap will remain engaged with its strap even during a collision. Thus after the collision, the door panel, its slide and slide restraint should all automatically return to their normal operating conditions. In some applications, however, it may be desirable to make the slide from a ring or S-hook of marginally adequate strength to serve as a relatively inexpensive "weak link." In the event of a collision, the weak link breaking away could prevent damaging something more expensive. It should be noted that an obvious variation to the embodiment just described, would be to attach slides 84*a*, 84*b*, 84*c* and 86*d* to wall 30, panel 14, panel 20 and wall 30 respectively, and mount their corresponding slide restraints 86*a*, 86*b*, 86*c* and 86*d* to panel 14, panel 16, panel 18 and panel 20 respectively. In other words, just exchange the mounting positions of the slides with those of the slide restraints, and vice versa.

Figure 15:
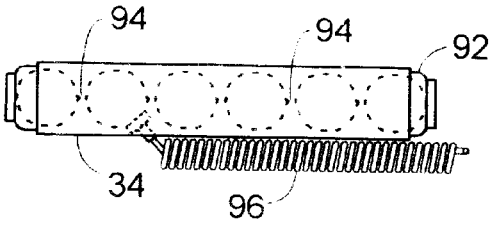
FIG. 15 is a top view of another embodiment of a door panel core.
Figure 16:
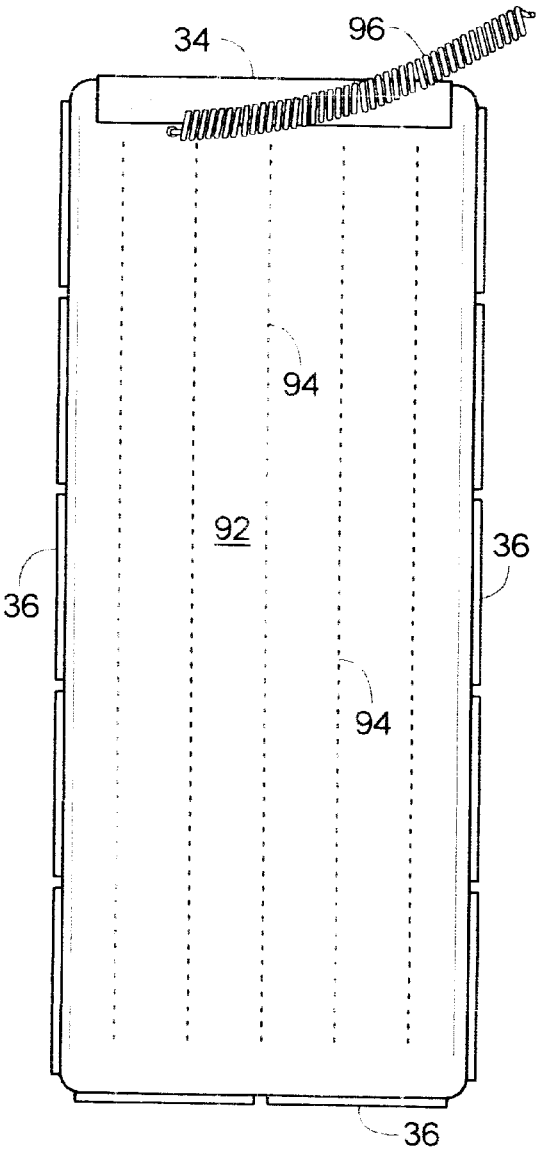
FIG. 16 is a front view of FIG. 15.
Figure 17:
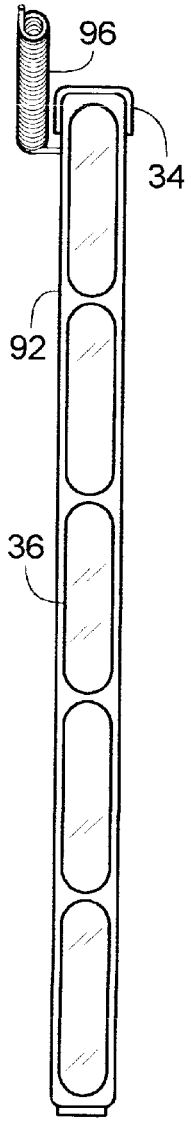
FIG. 17 is a right side view of FIG. 16.

In the embodiment of FIGS. 15, 16 and 17, which is similar to that of FIGS. 4, 5 and 6, a gas-inflated bladder 92 serves as the resilient core instead of foam 32. Bladder 92 is analogous to an air mattress in that it defines a compressible air chamber with internal baffles 94 to maintain a generally planar shape. In this example, bladder 92 consists of a flexible vinyl material that is heat bonded to itself to create baffles 94. A flexible air hose 96 connected to a conventional gas supply (preferably air) maintains a proper pressure within bladder 92. In some embodiments, a bladder 92 includes a predetermined leak, so that a continuous current of gas passes through bladder 92 to prevent frost from accumulating on the door. In the illustrated example, backup plates 36, support beam 34, and covering 40 are installed on bladder 92 in a manner similar to the mounting of those same items on foam core 32. It should be noted that a combination of foam core 32 and bladder 92 is well within the scope of the invention. For example, a resilient core for a door panel could primarily comprise a foam material with a narrow internal or adjacent air passageway to control frost buildup along certain limited areas that are most susceptible to frost, such as along the perimeter seals of the door panel.

Figure 18:
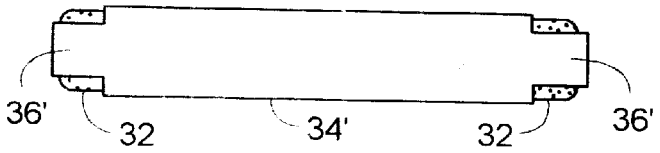
FIG. 18 is a top view of another embodiment of a door panel core.
Figure 19:
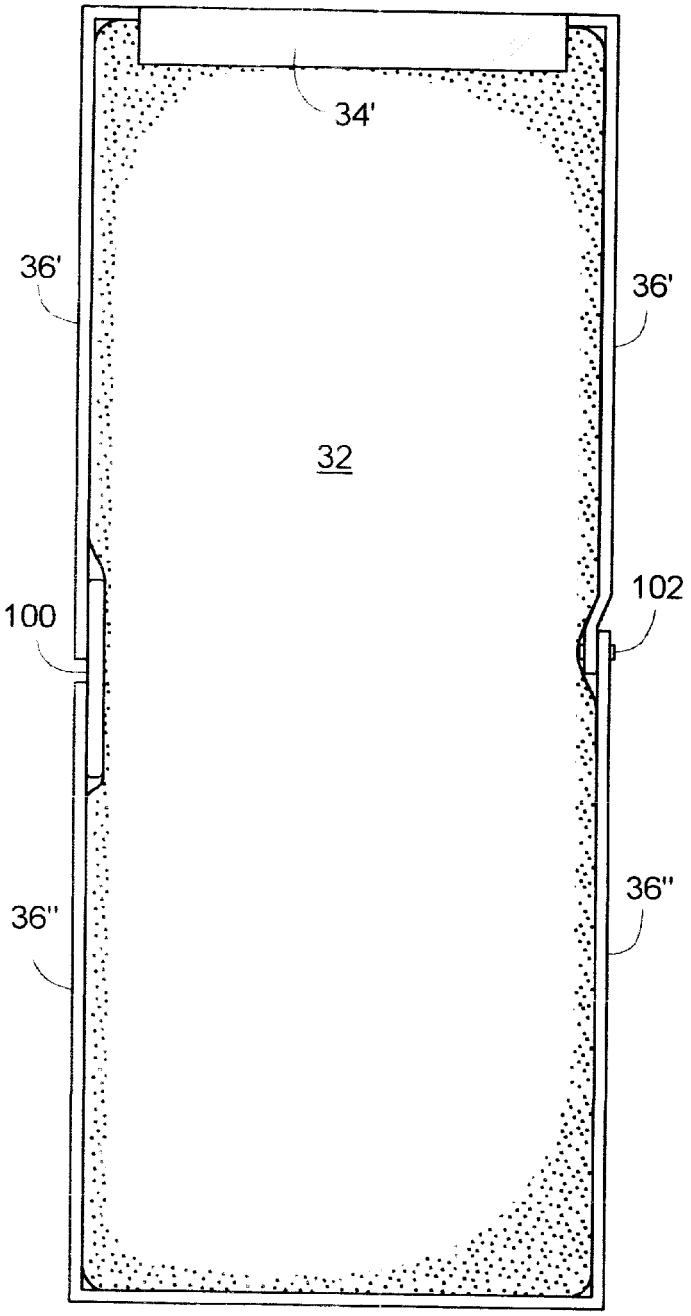
FIG. 19 is a front view of FIG. 18.
Figure 20:
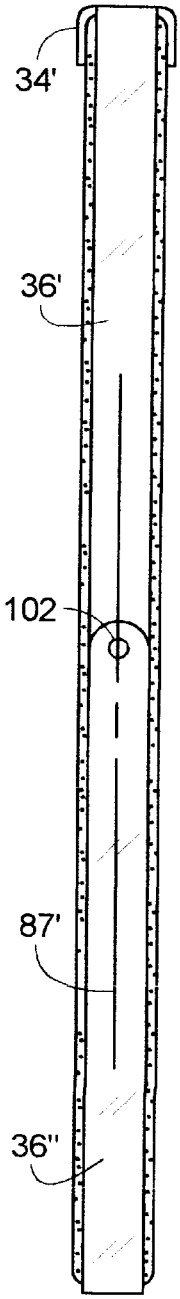
FIG. 20 is a right side view of FIG. 19.

In the embodiment of FIGS. 18, 19 and 20, which is similar to that of FIGS. 4, 5 and 6, foam core 32 is provided with some rigidity along plane 87' for seal positioning and/or seal compression by having the perimeter of core 32 supported by a relatively rigid back-up plate 36', back-up plate 36", and an upper support beam 34' (e.g., a channel similar to support beam 34). In this example, plate 36' extends from each end of channel 34' and plate 36" extends across the bottom and partially up along each side of core 32.

To allow core 32 some resilient flexibility during an impact, a moveable coupling connects plate 36' to 36". Such a coupling could assume a variety of structures or combination of structures including, but not limited to, a pliable bar 100 (e.g., made of a rubber or flexible plastic) and/or a pin 102. To illustrate two individual embodiments in a single drawing figure (i.e., FIG. 19), bar 100 is shown on the left and pin 102 is shown on the right. Bar 100 can be attached to plates 36' and 36" by an adhesive, a fastener, or some type of mechanical interlock (e.g., schematically illustrated bar 100 could be a rectangular tube into which plates 36' and 36" press-fit). Pin 102 and the flexibility of bar 100 allow plate 36" to rotates relative to plate 36' in the event that an impact deforms core 32 appreciably out of coplanar alignment with plane 87'. As with the embodiment of FIGS. 4, 5 and 6, core 32 and its perimeter support members are preferably encased by cover 40.

Although the invention is described with reference to a preferred embodiment, it should be appreciated by those skilled in the art that various modifications are well within the scope of the invention. Therefore, the scope of the invention is to be determined by reference to the claims that follow.

We claim:

1. A door for at least partially covering a doorway in a wall and being able to recover from an impact, comprising:

a resilient core;

a flexible covering that at least partially covers the resilient core to comprise a first door panel having a relaxed shape disposed along a plane, wherein the first door panel is able to substantially recover its relaxed shape after the impact causes appreciable distortion in the first door panel, and the first door panel is able to transmit in a direction within the plane a compressive load and do so without appreciable distortion to the first door panel;

an actuation system coupled to the first door panel to render the first door panel moveable laterally to the doorway between a doorway blocking position and an unblocking position while inhibiting the first door panel from rotating about a vertical axis; and a plurality of backup plates interposed between the resilient core and the flexible covering, wherein the plurality of backup plates have a rigidity greater than that of the resilient core and the flexible covering.

2. The door of claim 1, wherein the plurality of backup plates are spaced apart from each other.

3. The door of claim 1, wherein the plurality of backup plates define a clearance therebetween that allows a pair of adjacent backup plates to move relative to each other.

4. The door of claim 1, further comprising a replaceable seal secured between a cover plate and one of the plurality of backup plates.

5. The door of claim 4, wherein the first door panel has a substantially planar face and the replaceable seal protrudes out of coplanar alignment therewith.

6. A door for at least partially covering a doorway in a wall and being able to recover from an impact comprising:

a resilient core;

a flexible covering that at least partially covers the resilient core to comprise a first door panel having a relaxed shape disposed along a plane, wherein the first door panel is able to substantially recover its relaxed shape after the impact causes appreciable distortion in the first door panel, and the first door panel is able to transmit in a direction within the plane a compressive load and do so without appreciable distortion to the first door panel;

an actuation system having a carrier coupled to the first door panel to render the first door panel moveable laterally to the doorway between a doorway blocking position and an unblocking position while inhibiting the first door panel from rotating about a vertical axis; and a support beam coupled to the carrier and interposed between the resilient core and the flexible covering.

7. A door for at least partially covering a doorway in a wall and being able to recover from an impact, comprising:

a resilient core;

a flexible covering that at least partially covers the resilient core to comprise a first door panel having a relaxed shape disposed along a plane, the first door panel being at least thickness compressible and further being able to substantially recover its relaxed shape after an impact causes appreciable distortion in the first door panel, the first door panel being further able to transmit in a direction within the plane a compressive load having a magnitude below a first threshold without appreciable distortion to the first door panel;

an actuation system coupled to the first door panel to render the first door panel moveable laterally to the doorway between a doorway blocking position and an unblocking position while inhibiting the first door panel from rotating about a vertical axis;

a second door panel coupled to the actuation system and being substantially parallel with the first door panel and displaced out of coplanar alignment therewith;

a trailing edge seal extending from the first door panel towards the second door panel; and a leading edge seal extending from the second door panel towards the first door panel, wherein the first door panel and the second door panel both move in a first direction to close the door such that the trailing edge seal engages the leading edge seal, and wherein the first door panel and the second door panel both move in a second direction to open the door such that the trailing edge seal disengages the leading edge seal.

8. A door for at least partially covering a doorway in a wall and being able to recover from an impact that temporarily deforms the door, comprising:

an overhead track adapted to be mounted adjacent the doorway;

a resilient core;

a flexible covering that covers the resilient foam core to comprise a first door panel suspended from the overhead track; and a plurality of backup plates interposed between the resilient foam core and the flexible covering, wherein the plurality of backup plates have a rigidity greater than that of the resilient foam core and the flexible covering, but are moveable relative to each other so that the resilient foam core, the flexible covering, and the plurality of backup plates being moveable provides the first door panel with sufficient flexibility and resilience to recover from the impact.

9. The door of claim 8, wherein the resilient core is foam.

10. The door of claim 8, wherein the resilient core is an inflatable bladder.

11. The door of claim 8, wherein the plurality of backup plates are spaced apart from each other.

12. The door of claim 8, further comprising a replaceable seal secured between a cover plate and one of the plurality of backup plates.

13. The door of claim 8, wherein the first door panel has a substantially planar face and the replaceable seal protrudes out of coplanar alignment therewith.

14. A door for at least partially covering a doorway in a wall and being able to recover from an impact that temporarily deforms the door, comprising:

an overhead track adapted to be mounted adjacent the doorway;

a resilient core;

a flexible covering that covers the resilient foam core to comprise a first door panel suspended from the overhead track; and a plurality of backup plates interposed between the resilient foam core and the flexible covering, wherein the plurality of backup plates have a rigidity greater than that of the resilient foam core and the flexible covering, but are moveable relative to each other;

a plurality of cover plates moveable relative to each other; and a replaceable seal secured between the plurality of backup plates and the plurality of cover plates so that the resilient foam core, the flexible covering, the plurality of backup plates being moveable, and the plurality of cover plates being moveable provides the first door panel with sufficient flexibility and resilience to recover from the impact.

15. The door of claim 14, wherein the plurality of backup plates define a clearance therebetween that allows a pair of adjacent backup plates to move relative to each other.

16. A door for at least partially covering a doorway in a wall and being able to recover from an impact, comprising:

a resilient core;

a flexible covering that at least partially covers the resilient core to comprise a first door panel having a relaxed shape disposed along a plane, the first door panel being at least thickness compressible and further being able to substantially recover its relaxed shape after an impact causes appreciable distortion in the first door panel, the first door panel being further able to transmit in a direction within the plane a compressive load having a magnitude below a first threshold without appreciable distortion to the first door panel;

an actuation system coupled to the first door panel to render the first door panel moveable laterally to the doorway between a doorway blocking position and an unblocking position while inhibiting the first door panel from rotating about a vertical axis; and a plurality of backup plates interposed between the resilient core and the flexible covering, wherein the plurality of backup plates have a rigidity greater than that of the resilient core and the flexible covering.

17. The door of claim 16, wherein the plurality of backup plates are spaced apart from each other.

18. The door of claim 16, wherein the plurality of backup plates define a clearance therebetween that allows a pair of adjacent backup plates to move relative to each other.

19. The door of claim 16, further comprising a replaceable seal secured between a cover plate and one of the plurality of backup plates.

20. The door of claim 18, wherein the first door panel has a substantially planar face and the replaceable seal protrudes out of coplanar alignment therewith.

21. A door for at least partially covering a doorway in a wall and being able to recover from an impact, comprising:

a resilient core;

a flexible covering that at least partially covers the resilient core to comprise a first door panel having a relaxed shape disposed along a plane, the first door panel being at least thickness compressible and further being able to substantially recover its relaxed shape after an impact causes appreciable distortion in the first door panel, the first door panel being further able to transmit in a direction within the plane a compressive load having a magnitude below a first threshold without appreciable distortion to the first door panel;

an actuation system coupled to the first door panel to render the first door panel moveable laterally to the doorway between a doorway blocking position and an unblocking position while inhibiting the first door panel from rotating about a vertical axis; and a carrier securing the first door panel to the actuation system and a support beam coupled to the carrier and interposed between the resilient core and the flexible covering.

22. A door for at least partially covering a doorway in a wall and being able to recover from an impact, comprising:

a resilient core;

a flexible covering that at least partially covers the resilient core to comprise a first door panel having a relaxed shape disposed along a plane, wherein the first door panel is able to substantially recover its relaxed shape after the impact causes appreciable distortion in the first door panel, and the first door panel is able to transmit in a direction within the plane a compressive load and do so without appreciable distortion to the first door panel;

an actuation system coupled to the first door panel to render the first door panel moveable laterally to the doorway between a doorway blocking position and an unblocking position while inhibiting the first door panel from rotating about a vertical axis; and at least one backup plate interposed between the resilient core and the flexible covering, wherein the at least one backup plate has a rigidity greater than that of the resilient core and the flexible covering.

* * * * *